US007347643B2

(12) United States Patent
Jeong

(10) Patent No.: US 7,347,643 B2
(45) Date of Patent: Mar. 25, 2008

(54) ROAD STUD

(76) Inventor: Bo-Young Jeong, 320-1, Maseoku-ri, Hwado-eup, Namyangjusi, Gyeonggi-do, 472-845 (KR)

( * ) Notice: Subject to any disclaimer, the term of this patent is extended or adjusted under 35 U.S.C. 154(b) by 0 days.

(21) Appl. No.: 11/568,654

(22) PCT Filed: May 6, 2005

(86) PCT No.: PCT/KR2005/001336

§ 371 (c)(1),
(2), (4) Date: May 1, 2007

(87) PCT Pub. No.: WO2005/107376

PCT Pub. Date: Nov. 17, 2005

(65) Prior Publication Data

US 2007/0280781 A1 Dec. 6, 2007

(30) Foreign Application Priority Data

May 6, 2004 (KR) ..... 10-2004-0031961

(51) Int. Cl.
*E01F 9/06* (2006.01)

(52) U.S. Cl. ..... 404/13; 404/16; 404/71; 340/928

(58) Field of Classification Search ..... 404/11, 404/12, 13, 14, 15, 16, 71; 359/531; 340/928
See application file for complete search history.

(56) References Cited

U.S. PATENT DOCUMENTS 4,925,335 A 5/1990 Eigenmann
4,926,163 A * 5/1990 Beebe ..... 340/581
4,993,868 A 2/1991 Eigenmann
5,710,558 A * 1/1998 Gibson ..... 340/933
6,602,021 B1 * 8/2003 Kim ..... 404/16
6,726,398 B2 * 4/2004 Hamakawa et al. ..... 404/13
7,258,507 B2 * 8/2007 Kim et al. ..... 404/15
2004/0119609 A1 * 6/2004 Solomon ..... 340/928
2006/0193691 A1 * 8/2006 Gonzalez et al. ..... 404/15

FOREIGN PATENT DOCUMENTS

GB 1 537 756 * 1/1979
JP 5-89514 U 12/1993

* cited by examiner

*Primary Examiner*—Gary S. Hartmann
(74) *Attorney, Agent, or Firm*—Sughrue Mion, PLLC

(57) ABSTRACT

Provided herein is a road stud used to recognize the central line or lanes of a road. The road stud is configured in the form of a screw to be securely fixed to and buried in a road. The road stud includes a self generator to light up an illuminating element all the time irrespective of the existence and absence of sunshine or illumination, humidity and temperature sensors for sensing the condition of the road to emit different color lights in response to various conditions of the road, and a communication unit for transmitting/receiving information about the condition of the road to/from cars. The road stud has strong shock-resistance and smoothly emit light irrespective of existence or absence of external power supply or the quantity of sunshine. Furthermore, the road stud can indicate various road conditions by different colors of light-emitting diodes using measurement values of the temperature sensor and the humidity sensor and inform an ITS of the road conditions through the communication unit such that drivers can be informed of the traffic condition of the road where the road stud is buried.

4 Claims, 9 Drawing Sheets

ROAD STUD

TECHNICAL FIELD

The present invention relates to a road stud used to recognize the central line or lanes of a road, and more particularly, to a road stud that is configured in the form of a screw to be securely fixed to and buried in a road and includes a self generator to light up an illuminating element all the time irrespective of the existence and absence of sunshine or illumination, humidity and temperature sensors for sensing the condition of the road to emit different color lights in response to various conditions of the road, and a communication unit for transmitting/receiving information about the condition of the road to/from cars.

BACKGROUND ART

In general, a road stud is disposed on the central line of a road or lines partitioning the road into lanes such that users can recognize the central line or the lanes or disposed at a curved point of a winding road to allow cars to smoothly change their directions, to thereby seek safety driving and prevent traffic accidents.

The road stud is disposed on lines partitioning a road into lanes, the boundary of roads or the ends of the roads in such a manner that a hole is formed in a road, a lower support of the road stud is inserted into the hole and fixed using epoxy or cement. A reflector or a radiant is arranged on the surface of the road stub to allow car drivers to easily recognize the rod stud.

FIG. 1 is a perspective view of a conventional road stud 10 and FIG. 2 is a cross-sectional view of the conventional road stud 10 disposed on a road 40. Referring to FIGS. 1 and 2, the road stud 10 includes a head 20 exposed to the outside from the surface of the road and a support 30 buried in the road. The road stud 10 can use natural light or light reflected from lights of cars or emit light using electricity generated internally.

When the road stud 10 uses reflected light, light reflectors 22 having an oval or round shape are formed on the sides of the head 20 and the top face of the head 20 is flat or has reflectors 24 formed thereon to smoothly reflect light. The support 30 of the road stud 10 is in the form of pole such that it can be inserted into a hole 42 formed in the road 40. The support 30 is inserted into the hole 42 and then fixed using epoxy or cement 44 to prevent the road stud from being removed.

When the road stud 10 emits light using electricity internally generated, luminous bodies 22 emitting light by electricity are disposed on the sides of the head 20. The surfaces of the luminous bodies have a round or oval shape. In addition, solar cells 24 are disposed on the top face of the head 20 to generate electricity using sunray, and a storage battery (not shown) is provided inside the road stud 10 to store the electricity generated using sunray. A method and configuration for fixing the road stud 10 to the road are identical to the method and configuration using the reflectors so that explanations therefor are omitted.

The aforementioned road stud 10 is buried in the boundary, the central line and the ends of a road to reflect light from headlights of cars with the reflecting plates 22 or emit light from the luminous bodies 22 to allow drivers to recognize the boundary of the road, thereby promoting safety driving.

However, the conventional road stud requires a separate bonding material such as epoxy or cement to be buried in the road. The epoxy or cement can be damaged by a shock applied thereto when cars pass the road stud and thus the road stud can be removed from the road. Furthermore, the road stud using the reflectors cannot smoothly reflect light from headlights of cars when the reflectors are covered with particles such as dust. In the case of the road stud using stored electricity, electricity is not properly stored in the road stud in case of poor sunshine to result in poor emission of light.

DISCLOSURE OF INVENTION

Technical Problem

Accordingly, the present invention has been made to solve the above-mentioned problems occurring in the prior art, and it is an object to provide a road stud which can be easily buried in a road without using a separate bonding means, securely fixed to the road such that it is not easily removed from the road by a shock applied thereto when cars pass, generate electricity irrespective of the quantity of sunshine without using a separate power supply to operate luminous bodies, emit different color lights in response to various conditions of the road to inform drivers of the conditions of the road, and transmit/receive information about the conditions of the road to/from cars.

Technical Solution

The present invention has been accomplished by providing a screw type road stud. The road stud has a washer function to be securely buried in a road. Furthermore, the road stud includes a self generator to convert vibration generated when cars run into electricity and uses the electricity for emitting light or stores the electricity to smoothly emit light all the time irrespective of the quantity of sunshine. In addition, the road stud includes humidity and temperature sensors to emit different color lights in response to various conditions of the road to inform drivers of the condition of the road. The road stud further includes a communication unit to allow the drivers to monitor the condition of the road.

The road stud according to the present invention includes a head exposed to the outside from the surface of the road and a part buried in the road. The cross-section of the head has a half-oval shape such that car wheels are less damaged when run on the road stud. The head includes a light-emitting part, a sensing part and a reflecting part. The head further includes a cross screwdriver groove.

The buried part is configured in the form of a screw and has a round-shape washer on its top coming into contact with the head. The flange of the washer is bent downward. The buried part includes a self generator capable of generating and charging electricity (Korean Patent Application No. 10-2004-0024706, filed on Apr. 10, 2004, entitled "self generator for converting small kinetic energy into electric energy") applied by the Applicant and a controller for controlling the self generator, the light-emitting part, the sensing part, and the communication unit which will be explained later.

The light-emitting part and the sensing part are arranged in a radial manner inside a transparent outer body of the head and include light bulbs or light-emitting diodes capable of emitting various color lights, and temperature and humidity sensors. The reflecting part including a reflector for reflecting light from headlights of cars is formed around the light-emitting part and the sensing part. The screwdriver groove is used to drive or loosen the screw-shaped road stud such that the road stud can be buried into a road or removed from the road.

The self generator (Korean Patent Application No. 10-2004-0024706) includes a self power generating part, a power transmitting part for transmitting power generated by the self power generating unit to an electricity generating part, the electricity generating part composed of a stator and a rotor to generate electricity using the power transmitted by the power transmitting part, and an expanding/contracting part disposed at one side of the rotor to which the power of the self power generating unit is transmitted to maintain the power for a long time.

The communication unit is used to communicate between road studs, between a road stud and a car having a telematics terminal mounted therein, and between a road stud and an intelligent transportation system (ITS) using a transmission/reception antenna included therein.

The controller including a signal pre-processor embedded in a buried portion of the inventive road stud, a transmitting/receiving circuit and a microprocessor controls the aforementioned components of the road stud.

Advantageous Effects

The road stud of the present invention is configured in the form of a screw having the washer disposed on its top, and thus the road stud is not removed and separated from the road even when a shock or vibration generated when cars pass by the road stud but securely buried in the road. The exposed surface of the road stud has a half-oval shape such that car wheels do less damage to the road stud. Furthermore, the road stud of the present invention includes the self generator to smoothly radiate irrespective of the existence or absence of an external power supply or the quantity of sunshine. In addition, the road stud indicates the condition of the road by the color of the light-emitting part in response to measurement values of the temperature and humidity sensors and thus drivers can timely recognize the condition of the road or weather condition around the road from the color of the light-emitting part. Moreover, the road stud can perform its function by reflecting light from headlights of cars using the reflector even when an electric system has a trouble. Furthermore, the road stud informs an ITS of the condition of the road through the communication unit included therein such that drivers or users can be informed of the traffic conditions of the road where the road stud is buried.

DESCRIPTION OF DRAWINGS

Further objects and advantages of the invention can be more fully understood from the following detailed description taken in conjunction with the accompanying drawings, in which.

BEST MODE FOR INVENTION

Figure 1:
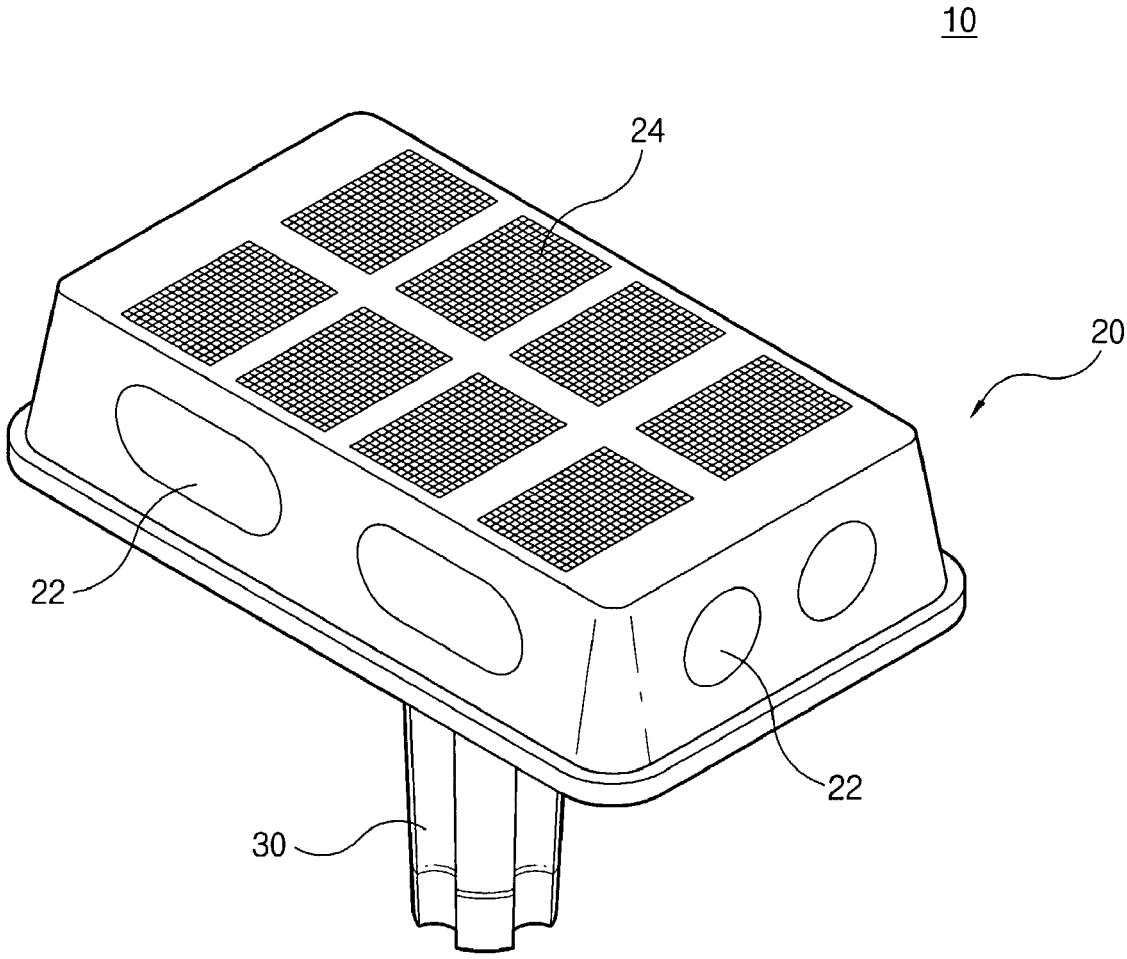
FIG. 1 is a perspective view of a conventional road stud.
Figure 2:
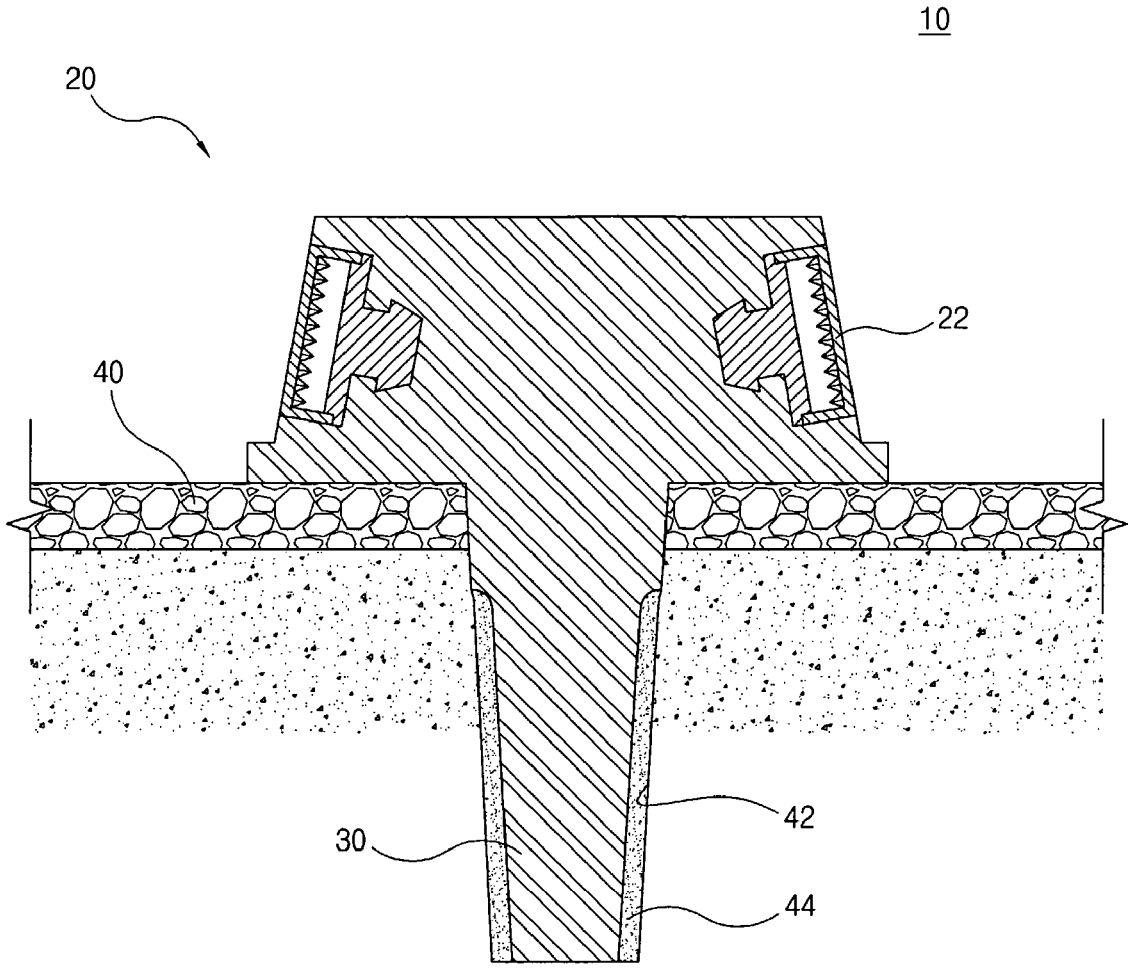
FIG. 2 is a cross-sectional view of the conventional road stud buried in a road.

The present invention will now be described in detail in connection with preferred embodiments with reference to the accompanying drawings. For reference, like reference characters designate corresponding parts throughout several views.

Figure 3:
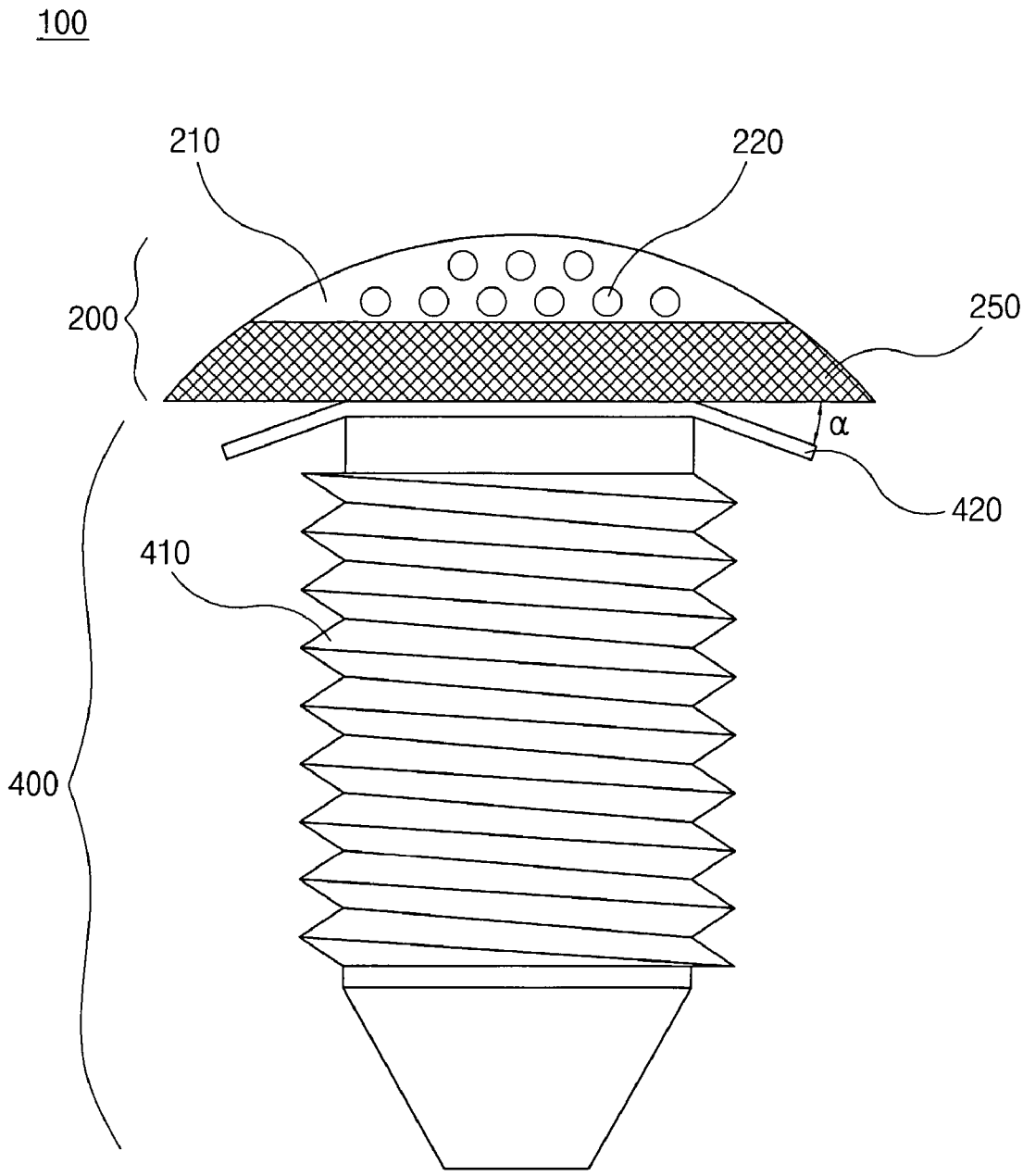
FIG. 3 is a side view of a road stud according to the present invention.
Figure 4:
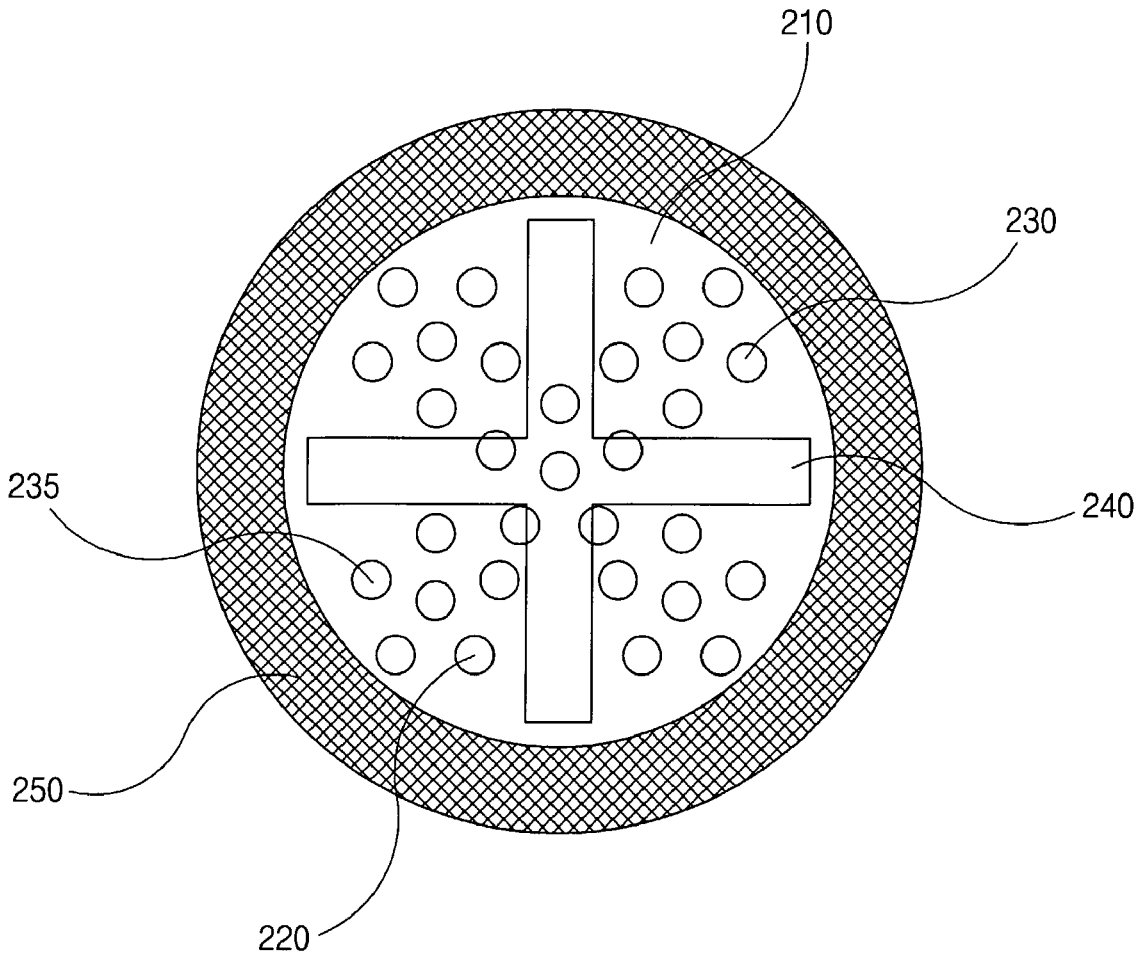
FIG. 4 is a plan view of the road stud according to the present invention.
Figure 5:
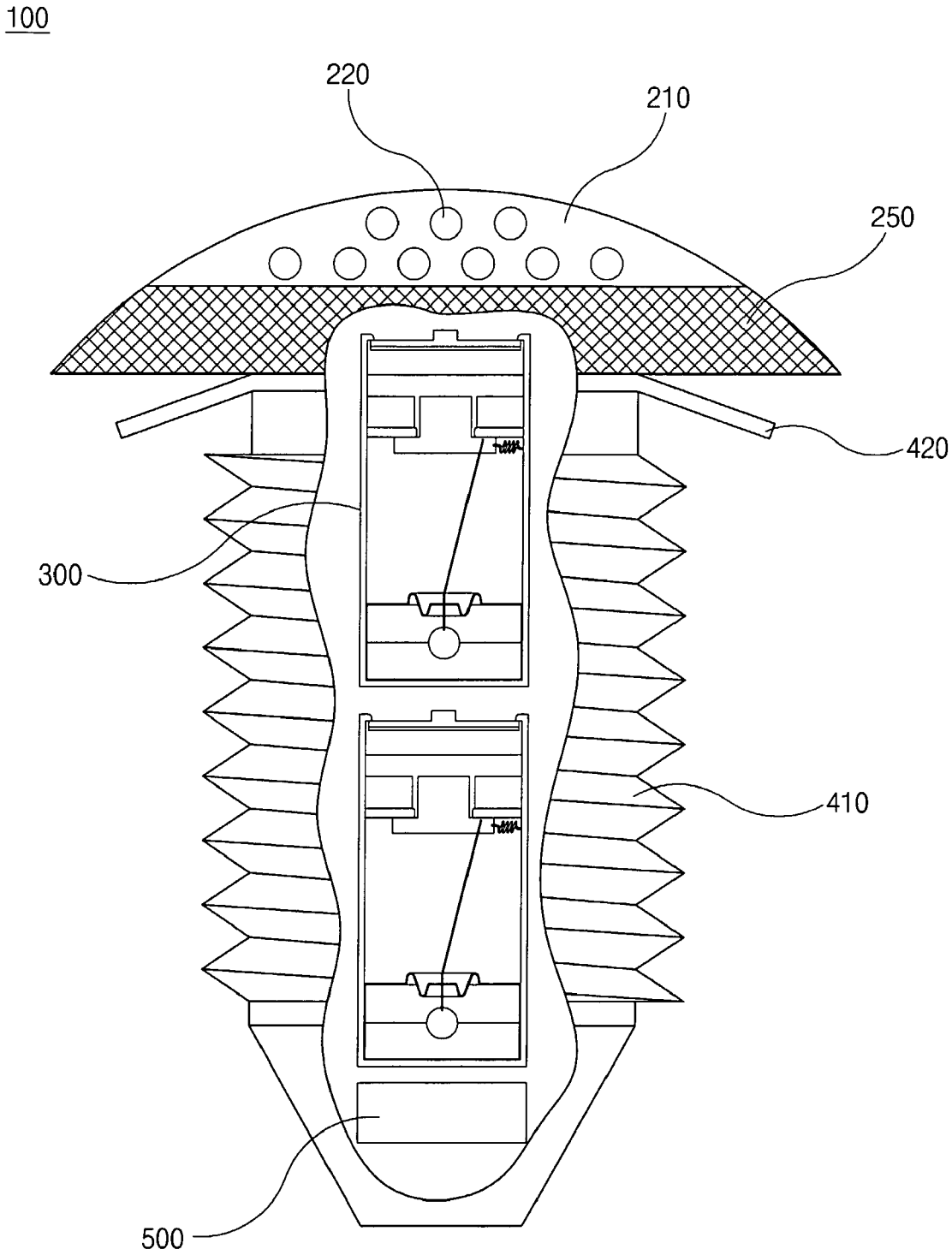
FIG. 5 illustrates the inside of a buried part of the road stud according to the present invention.
Figure 6:
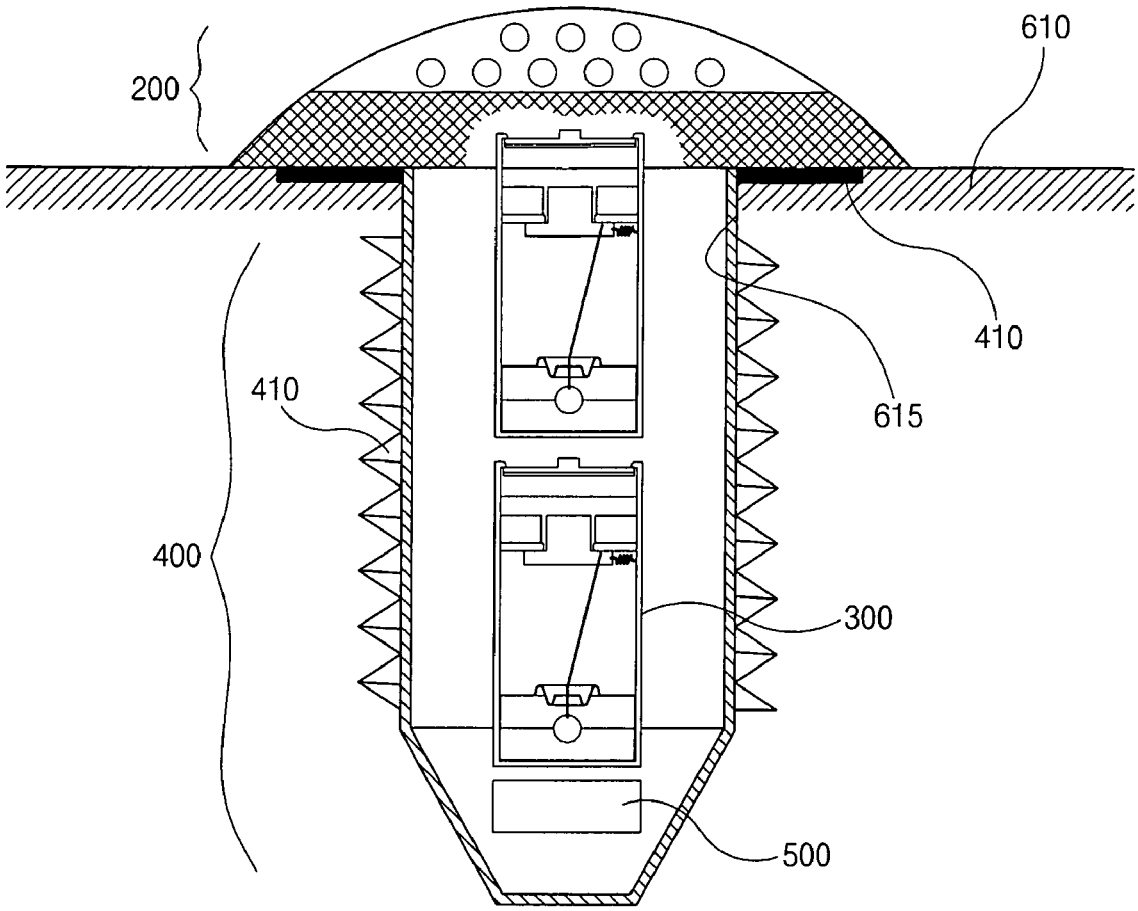
FIG. 6 is a cross-sectional view of the road stud according to the present invention when the road stud is buried in a road.
Figure 7:
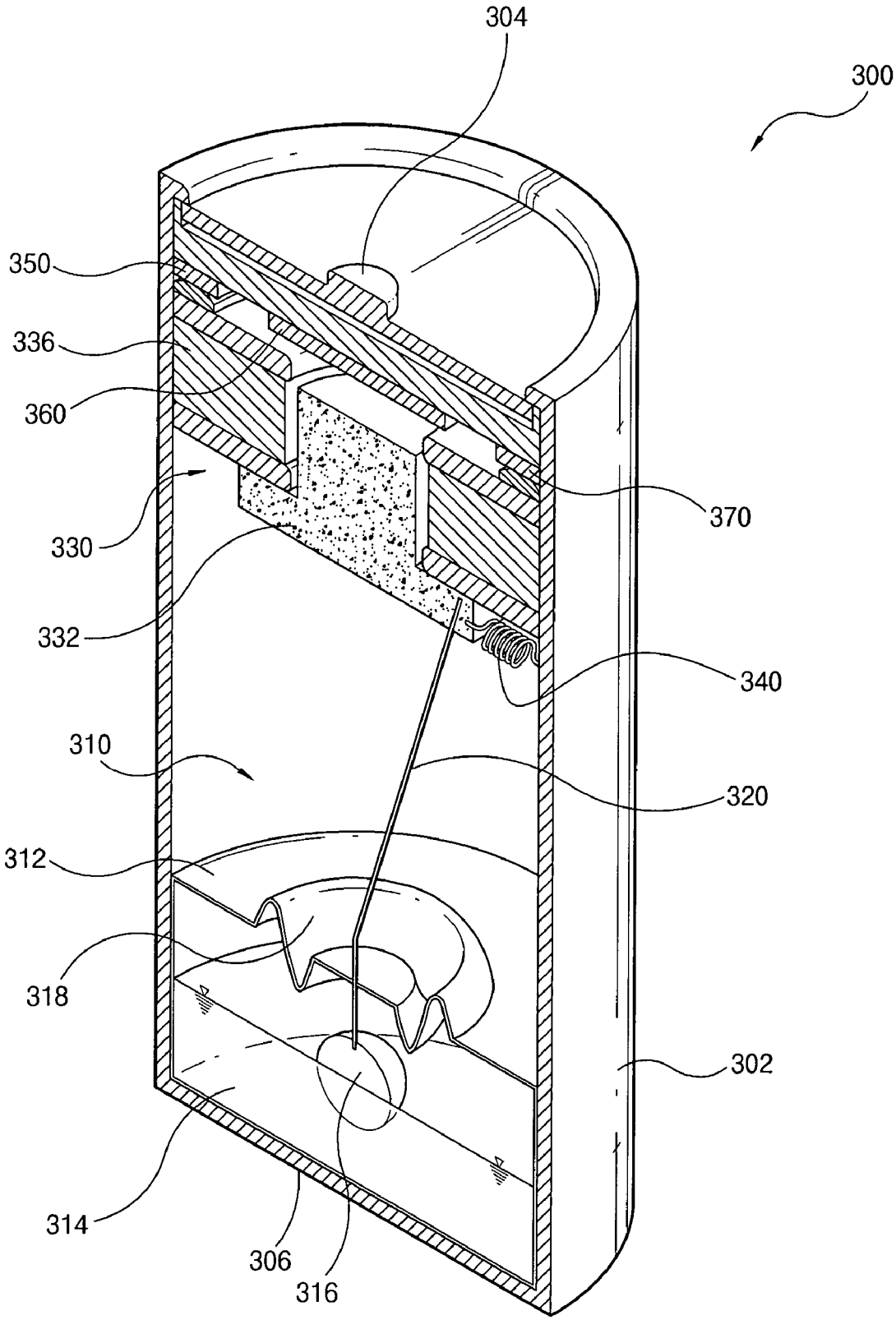
FIG. 7 is a cross-sectional prospective view of a self generator of the road stud according to the present invention.
Figure 8:
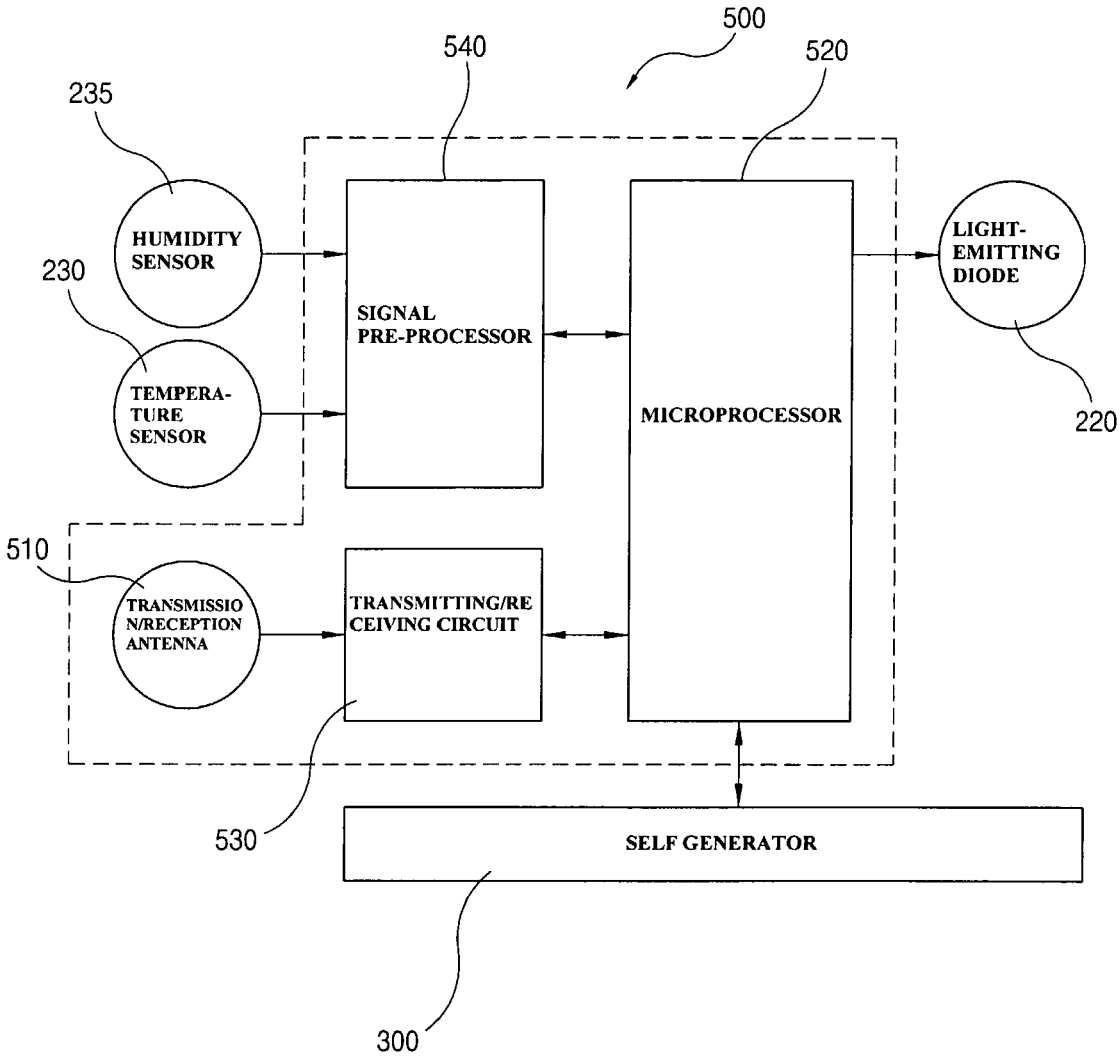
FIG. 8 is a block diagram showing the systematic configuration of the road stud according to the present invention.
Figure 9:
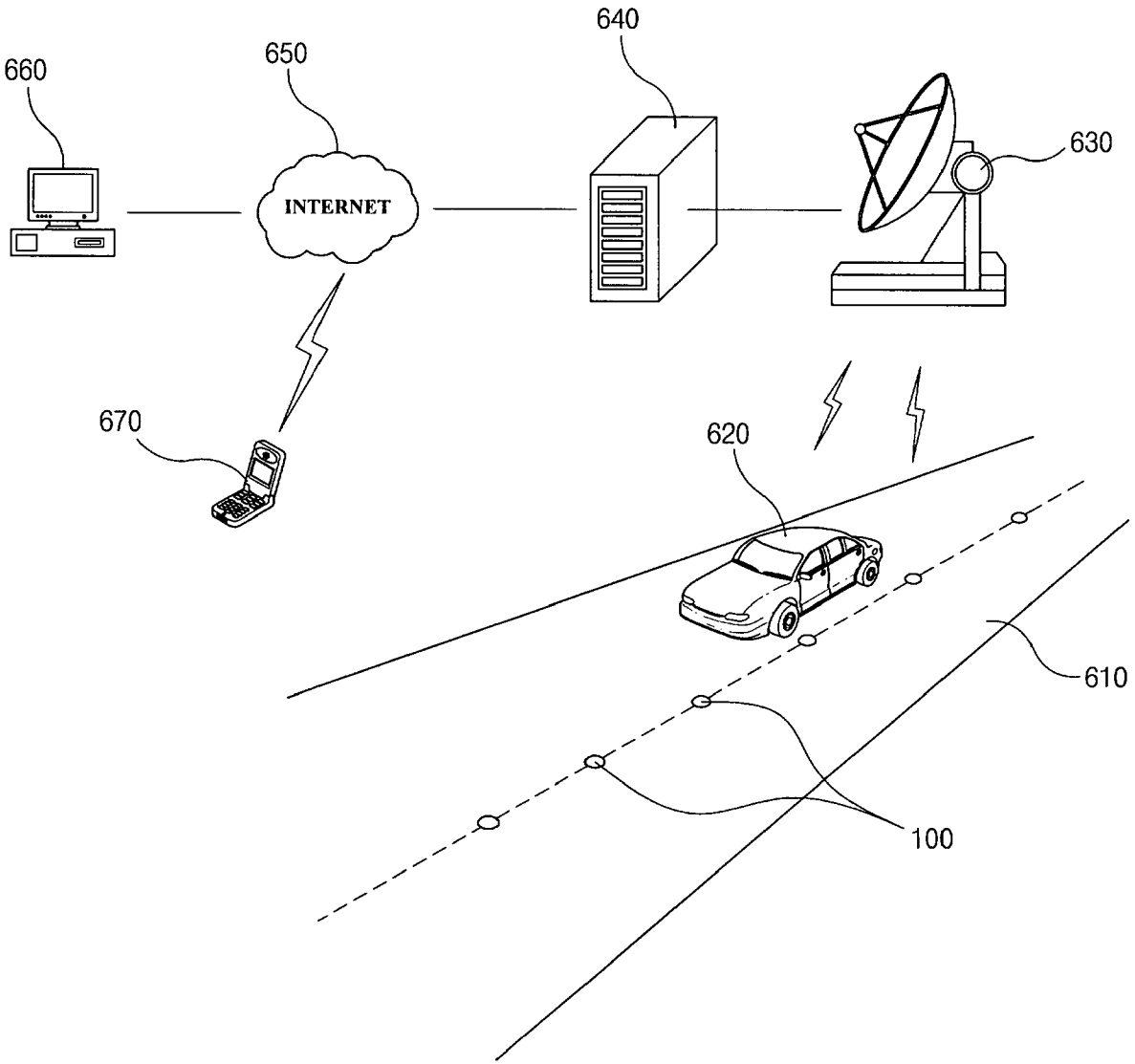
FIG. 9 illustrates the configuration of the road stud according to the present invention and an intelligent transportation system center.

FIG. 3 is a side view of a road stud 100 according to the present invention, FIG. 4 is a plan view of the road stud 100 according to the present invention, and FIG. 5 illustrates the inside of a buried part of the road stud 100 according to the present invention. FIG. 6 is a cross-sectional view of the road stud 100 according to the present invention when the road stud is buried in a road, and FIG. 7 is a cross-sectional prospective view of a self generator 300 of the road stud according to the present invention. FIG. 8 is a block diagram showing the systematic configuration of the road stud 100 according to the present invention, and FIG. 9 illustrates the configuration of the road stud 100 according to the present invention and an intelligent transportation system center.

The road stud 100 of the present invention includes a head 200 exposed when the road stud 100 is buried in a road and a part 400 buried in the road. The head 200 includes an outer body 210 exposed to the outside, light-emitting diodes 220, a temperature sensor 230, a humidity sensor 235, a cross-like groove 240, and a reflector 250. The outer body 210 is formed of a transparent material, and the cross-section of the outer body 210 is in the form of a half-oval shape. The light-emitting diodes 220 are arranged in a cross shape inside the outer body 210 to emit red, yellow and blue lights. The temperature sensor 230 and the humidity sensor 235 are arranged in the outer body in such a manner as to be dispersed together with the light-emitting diodes 220, so as to measure the temperature and humidity of the road. The cross-like groove 240 is formed, by a predetermined depth, on the surface of the outer body 210 of the head 200 and is configured in a cross shape such that it does not interfere with the light-emitting diodes 220, the temperature sensor 230 and the humidity sensor 235. The reflector 250 is disposed at the outer circumference of the outer body 210 to reflect light from headlights of cars.

The buried part 400 is configured in the form of a screw having screw threads 410. The lower portion of the buried part 400 is tapered. In addition, the buried part 400 includes a washer 420 in the form of round plate, which is disposed on the top of the buried part and comes into contact with the bottom face of the head 200. The flange of the washer 420 is bent downward from the edge of the surface of the buried part 400 by a predetermined angle $\alpha$.

The road stud 100 includes a self generator 300 inside thereof. The self generator 300 (Korean Patent Application. No. 10-2004-0024706, applied by the Applicant) converts vibration generated when cars run on the road into electric energy and stores electricity. The road stud 100 further includes a control box 500 including a microprocessor 520, a transmitting/receiving circuit 530 and a signal pre-processor 540 to control the self generator 300, the light-emitting diodes 220, the temperature sensor 230, the humidity sensor 235 and a transmission/reception antenna 510 included therein. The control box 500 is composed of a microprocessor and circuits conventionally used and thus its components can be connected and operated using conventional techniques.

Referring to FIG. 7, the self generator 300 includes a self power generating part that responds to even weak vibration to generate power, a power transmitting part for transmitting the power generated by the self power generating part to an electricity generating part, the electricity generating part composed of a stator and a rotor to generate electricity using the power transmitted from the power transmitting part, and an expanding/contracting part disposed at one side of the rotor to which the power of the self power generating part is transmitted to maintain the power for a long period of time.

The self power generating part is composed of a membrane 312 having the same shape as the inner side and bottom of a case 302, a liquid 314 such as water filled in the case 302 to half the height of the membrane 312, and a buoy 316 floated on the liquid 314 with its predetermined portion dipped in the liquid 314. A protrusion and a depression 318 are formed on the membrane 312 and they have different distances from the center of the membrane. The power transmitting part is a steel wire 320 that is fixed to the top of the buoy 316 and passes through the center of the protrusion and depression 318.

The electricity generating part is an electricity generator 330 including a rotor 332 and a stator 336. The rotor 332 revolves forward and backward by vibration energy transmitted thereto via the steel wire 320 and is in the form of felt hat on which a plurality of permanent magnets are arranged along its edge. The stator 336 has a diameter larger than the diameter of the lower part of the rotor 332. A coil winds round the stator 336 such that the stator 336 generates an induced electromotive force according to the revolution of the rotor 332 to generate electricity.

The relating/contracting part is a coil spring 340 fixed to the side of the lower end of the rotor 332, to which vibration of the buoy 316 is transferred via the steel wire, and to the upper part of the inner side of the case 302 to maintain the force of vibration energy for a long time without weakening it.

The operation of the road stud according to an embodiment of the present invention will now be explained with reference to FIGS. 1 to 9. FIG. 9 illustrates a system configuration in which the road stud is operated.

A hole 615 (referring to FIG. 6) is formed in a portion where the road stud 100 will be buried, such as the boundary, the central line or the end of a road 610, the tapered portion of the buried part 400 of the road stud 100 is inserted into the hole 615, and then the road stud 100 is driven into the bottom end of the hole 615 according to the screw thread 410 using a screwdriver (not shown) with its tip disposed in the cross-like groove 240. Here, the washer 420 becomes flat and eventually pulls up the road stud 100 according to elasticity as the road stud 100 is inserted into the hole 615 deeper and deeper because the flange of the washer 420 is bent downward by a predetermined angle $\alpha$, and force opposite to the elasticity operates by the screw thread 410 being inserted into the hole 615. Accordingly, the road stud 100 is securely buried.

The buried road stud 100 includes the self generator 300 and thus it can convert vibration generated when cars run on the road into electric energy to light the light-emitting diodes 220. Furthermore, the road stud 100 can store remaining electric energy such that the light-emitting diodes 220 can continuously emit light even when cars do not run on the road.

The temperature sensor 230 and the humidity sensor 235 measure the temperature and humidity of the road 610, and light red light-emitting diodes when the surface of the road 610 is slippery because of snow or rain, yellow light-emitting diodes having the longest visibility range in case of fog, and blue light-emitting diodes in case of normal road condition, to thereby inform drivers of the road condition in advance. Here, the light-emitting diodes 220 having different colors can emit light and be recognized by drivers even when they are dispersed inside the outer body 210 of the road stud 100 without having regularity. The microprocessor 520 processes the values measured by the temperature sensor 230 and the humidity sensor 235 and applies power to light-emitting diodes having a color suitable for the condition corresponding to the measured values to light the corresponding light-emitting diodes. The measured values are not fixed because they are varied with characteristics of areas and roads.

In the operation of the ITS, the road stud 100 can communicate with other road studs, a car 620 having a telematics terminal mounted therein, and an ITS relay 630 through the transmission/reception antenna 510 to monitor traffic. Specifically, the microprocessor 520 of the road stud 100 processes data such as collected road conditions, road surface states and flow of car 620 and transmits/receives the data to/from the ITS relay 630 through the transmitting/receiving circuit 530. A data center 640 processes the data to be aware of overall information about the road where the road stud is buried and provides information about traffic jam or weather condition to the telematics terminal mounted in the car 620 or to a wired Internet user 660 or a wireless Internet user 670 connected to the Internet 650.

INDUSTRIAL APPLICABILITY

While the present invention has been described with reference to the particular illustrative embodiments in which a road stud is configured in the form of a screw with a washer disposed on its top and includes a self generator, a controller for controlling the power generator and a communication unit, it is not to be restricted by the embodiments but only by the appended claims. It is to be appreciated that those skilled in the art can change or modify the embodiments without departing from the scope and spirit of the present invention.

The invention claimed is:

1. A road stud comprising:

a head exposed to the outside from the surface of a road, the head including an outer body exposed to the outside and formed of a transparent material, the cross-section of the outer body being in the form of a half-oval shape, light-emitting diodes arranged in a cross shape inside the outer body to emit red, yellow and blue lights, and a temperature sensor and a humidity sensor arranged in the outer body in such a manner as to be dispersed together with the light-emitting diodes, to measure the temperature and humidity of the road, wherein the outer body has a cross-like groove formed thereon by a predetermined depth, the cross-like groove being configured in a cross shape such that it does not interfere with the light-emitting diodes, the temperature sensor and the humidity sensor; and a part buried in the road, the buried part being in the form of a screw having screw threads, the lower portion of the buried part being tapered, the buried part including a self generator that converts vibration generated when cars run on the road into electric energy and stores electricity, and a control box including a microprocessor, a transmitting/receiving circuit and a signal preprocessor to control the self generator, the light-emitting diodes, the temperature sensor, the humidity sensor and a transmission/reception antenna included therein.

2. The road stud as claimed in claim 1, wherein the self generator includes:

a self power generating part:

a power transmitting means for transmitting the power generated by the self power generating part to an electricity generating part;

the electricity generating part for generating electricity using the power transmitted from the power transmitting part, the electricity generating part including a stator and a rotor;

and an expanding/contracting part disposed at one side of the rotor to which the power of the self power generating part is transmitted to maintain the power for a long time.

3. The road stud as claimed in claim 1 or 2, wherein the outer body of the head is further provided with a reflector disposed at the outer circumference thereof so as to reflect light from headlights of cars.

4. The road stud as claimed in claim 1 or 2, wherein a washer having a round plate is formed on the top of the buried part in such a manner as to come into contact with the bottom face of the head, the flange of the washer being bent downward by a predetermined angle $\alpha$.

* * * * *